US007524294B1

(12) United States Patent
Shelton et al.

(10) Patent No.: US 7,524,294 B1
(45) Date of Patent: Apr. 28, 2009

(54) ARM LIFT FLEXION DEVICE

(76) Inventors: Jean E. Shelton, 710 N. Broad St., Suffolk, VA (US) 23434; Hildreth H. Strode, 101 Colley Ave., Apt. 707, Norfolk, VA (US) 23510-1048

( * ) Notice: Subject to any disclaimer, the term of this patent is extended or adjusted under 35 U.S.C. 154(b) by 393 days.

(21) Appl. No.: 11/210,364

(22) Filed: Aug. 24, 2005

Related U.S. Application Data

(60) Provisional application No. 60/603,883, filed on Aug. 24, 2004.

(51) Int. Cl.
*A61H 1/02* (2006.01)

(52) U.S. Cl. ..... 601/5; 601/33

(58) Field of Classification Search ..... 601/5, 601/23, 24, 26, 33, 34, 35; 602/20, 32, 33; 482/905
See application file for complete search history.

(56) References Cited

U.S. PATENT DOCUMENTS

| | | | | |
|---|---|---|---|---|
| 2,902,696 | A | 9/1959 | Mittell et al. | |
| 3,769,636 | A | 11/1973 | Friedman | |
| 3,967,321 | A | 7/1976 | Ryan et al. | |
| 4,180,870 | A | 1/1980 | Radulovic et al. | |
| 4,237,873 | A | 12/1980 | Terry et al. | |
| 4,259,949 | A | 4/1981 | Axelsson | |
| 4,753,449 | A | 6/1988 | Doucet | |
| 4,878,685 | A | 11/1989 | Bahm | |
| 5,337,737 | A | 8/1994 | Rubin et al. | |
| 5,365,947 | A | 11/1994 | Bonutti | |
| 5,417,643 | A * | 5/1995 | Taylor | 601/33 |
| 5,472,410 | A | 12/1995 | Hamersly | |
| 5,476,241 | A | 12/1995 | Helman | |
| 5,683,353 | A | 11/1997 | Hamersly | |
| 5,685,719 | A | 11/1997 | Bressler | |
| 5,685,830 | A | 11/1997 | Bonutti | |
| 5,718,671 | A | 2/1998 | Bzoch | |
| 5,759,165 | A | 6/1998 | Malewicz | |
| 5,800,561 | A | 9/1998 | Rodriguez | |
| 5,865,714 | A | 2/1999 | Marlowe | |
| 5,951,499 | A * | 9/1999 | Saringer et al. | 601/5 |
| 6,179,799 | B1 | 1/2001 | Doran | |
| 6,689,077 | B2 | 2/2004 | Dabir | |

FOREIGN PATENT DOCUMENTS

| | | | |
|---|---|---|---|
| JP | 2003290293 | A | 10/2003 |

OTHER PUBLICATIONS

Engen, "Development Toward A. Controllable Orthopedic System For Restoring Useful Arm and Hand Actions," *Orthopedic & Prosthetic Applicance Journal*, Jun. 1963, pp. 184-197.

* cited by examiner

*Primary Examiner*—Danton DeMille
(74) *Attorney, Agent, or Firm*—Kevin W. Grierson

(57) ABSTRACT

The present invention describes an elbow flexion device that can be placed on a table or the tray of a wheelchair. The arm to be raised is placed into a cradle in the device for receiving such arm. Motion is controlled by means of a control device actuated by movement of the hand of the other arm.

13 Claims, 11 Drawing Sheets

ARM LIFT FLEXION DEVICE

PRIORITY CLAIM

This patent application claims priority from Provisional Patent Application No. 60/603,883, which was filed on Aug. 24, 2004, of which this application is a continuation.

TECHNICAL FIELD

The invention relates generally to devices for assisting the disabled in performing various motor functions. More particularly, the invention assists a person with raising his arm and hand via an arm lift flexion device actuated by the user.

BACKGROUND OF THE INVENTION

Duchenne Muscular Dystrophy (DMD) is the most common form of Muscular Dystrophy. It is characterized by progressive weakening of the limbs. Nearly all children with DMD lose the ability to walk sometime between ages 7 and 12. In the teen years, activities involving the arms, legs or trunk require assistance or mechanical support. In DMD, limitations of wrist movements generally begin by 8 years of age, and wrist, elbow and shoulder contractures begin between 8 and 14 years of age. Such deformities accelerate the loss of strength and function. As a consequence, many DMD patients lack the strength to raise their arms to a sufficient angle to allow them to feed themselves. These individuals, however, generally retain some use of their fingers and thumbs, and can, with assistance, continue to perform everyday tasks such as eating, grooming, adjusting glasses, etc.

Devices for assisting the disabled in performing various tasks are well-known, as are devices designed to assist persons in exercising their limbs. Various devices also exist to assist arm movement in patients who are unable to lift their arms without assistance. However, most of these devices are designed for patients who are paralyzed, and many require that the arm or other limb needing assistance be surrounded by a brace. Often, such devices are bulky and inconvenient, and cannot easily be transported by a person who is wheelchair bound. Many are so expensive that the majority of patients who would benefit from such devices cannot afford them.

SUMMARY OF THE INVENTION

It is therefore an object of this invention to provide an externally powered elbow flexion device that is less bulky than existing equipment.

It is a further objective to provide a device that does not obstruct the wheel chair tray for other purposes.

A further objective is to provide a device that is affordable.

In addition, it is a further objective to provide a device that can be controlled by small movements and with the application of small forces by the patient, particularly by the hand that is not being raised by the device, and thus do not require mobility for the unassisted hand to actuate.

The foregoing objectives are attained by an arm lift flexion device comprising a base, a pivot support mounted to the base, an actuator such as a motor mounted to the base, a drive screw attached to said actuator, a nut threaded to the drive screw and fixedly attached to a rigid strap, which is in turn attached to an arm cradle, such arm cradle pivoting on the pivot support, to which it is rotatably attached. The elbow flexion device is controlled by a control switch that, in a preferred embodiment, is actuated by the user using small movements of the hand that is not supported by the elbow flexion device.

Additional objects and advantages of embodiments of the invention will be set forth in part in the description that follows, and in part will be obvious from the description, or may be learned by practice of the invention. The objects and advantages of the invention will be obtained by means of instrumentalities in combinations particularly pointed out in the claims.

DISCLOSURE OF INVENTION

Brief Description of Drawings

The accompanying drawings illustrate a complete exemplary embodiment of the invention according to the best modes so far devised for the practical application of the principles thereof, and in which.

DETAILED DESCRIPTION OF A PREFERRED EMBODIMENT

Figure 1:
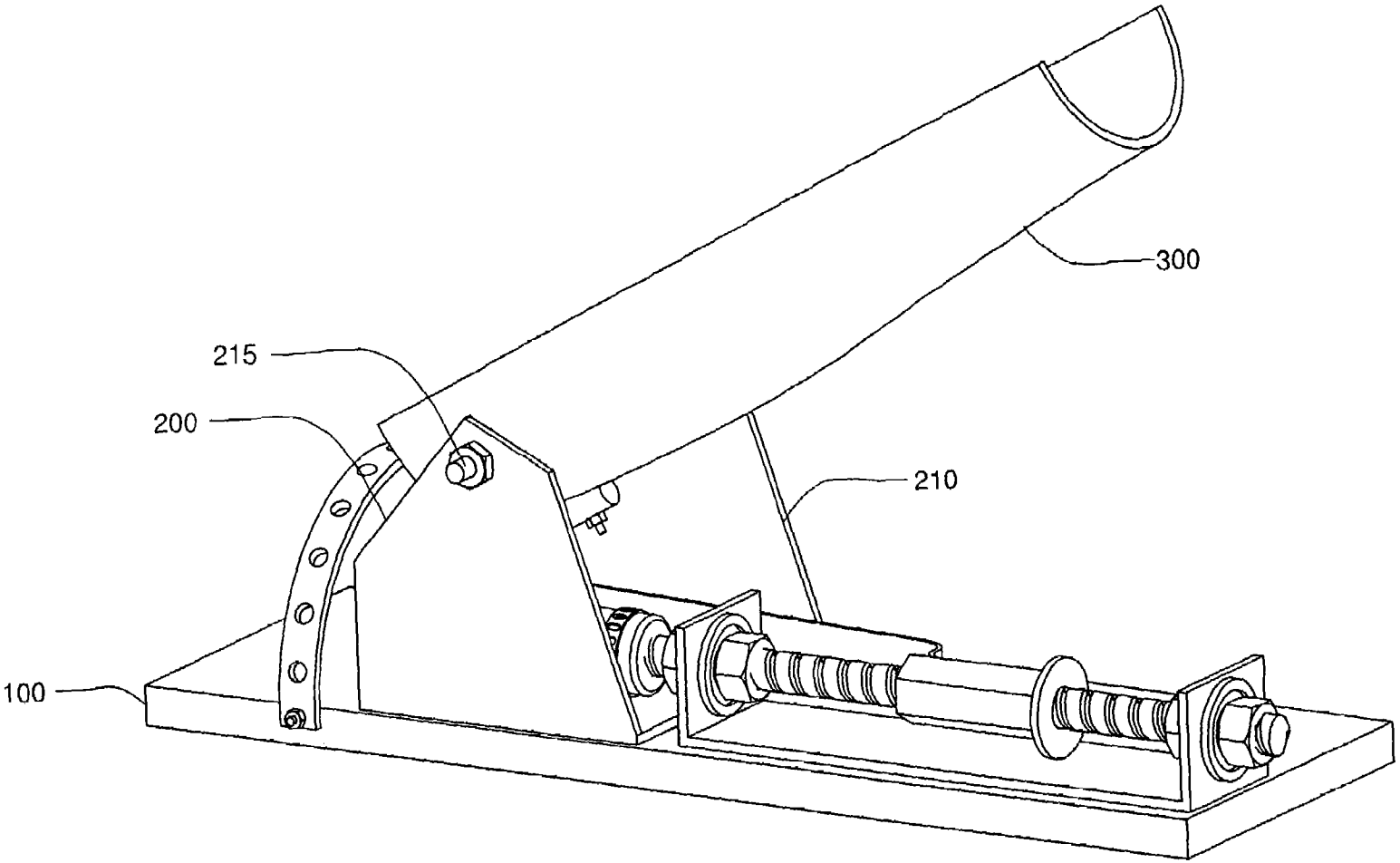
FIG. 1 shows a preferred embodiment of the elbow flexion device.
Figure 3:
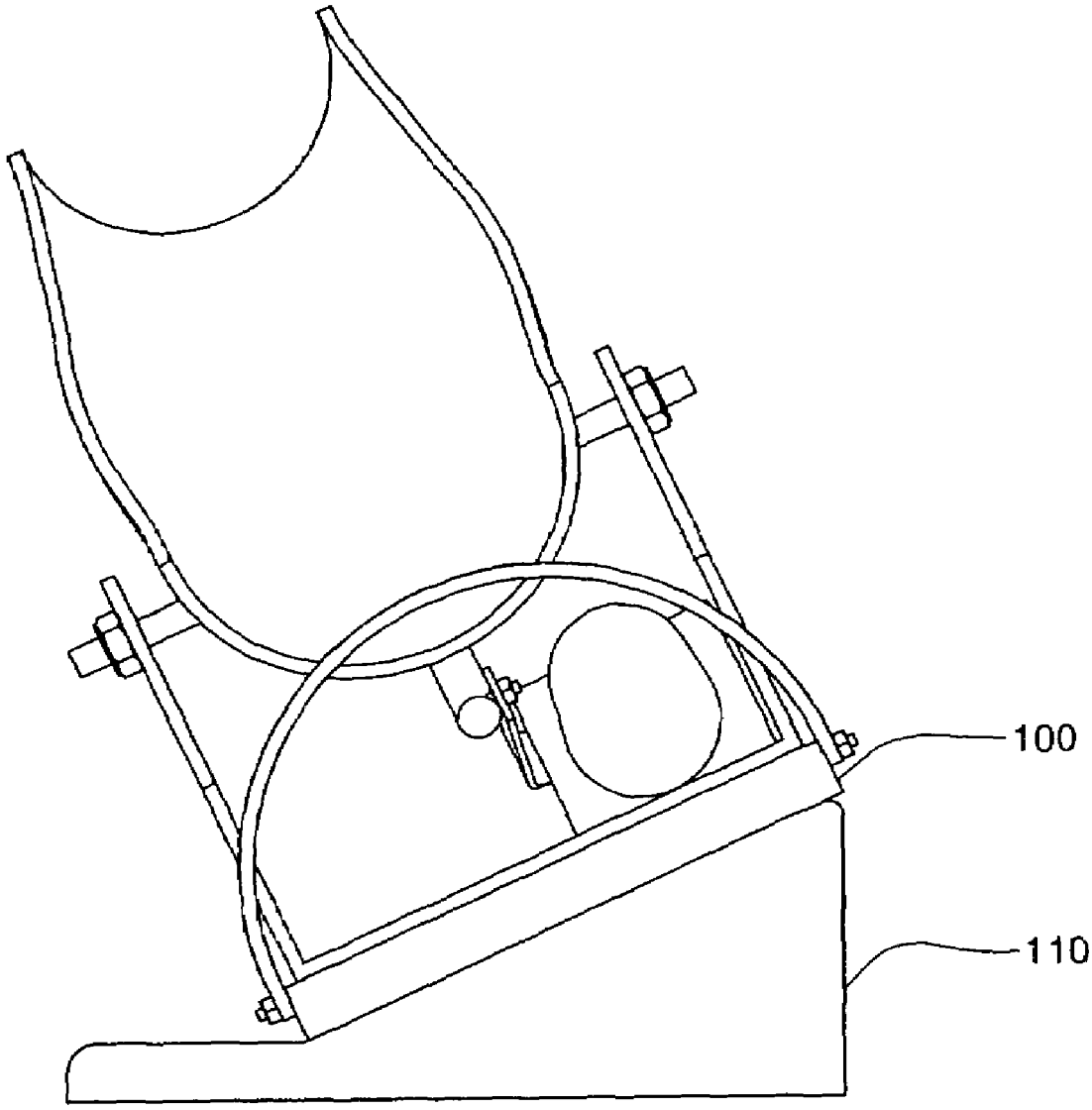
FIG. 3. Shows an end view of the base with extended angular support.
Figure 11B:
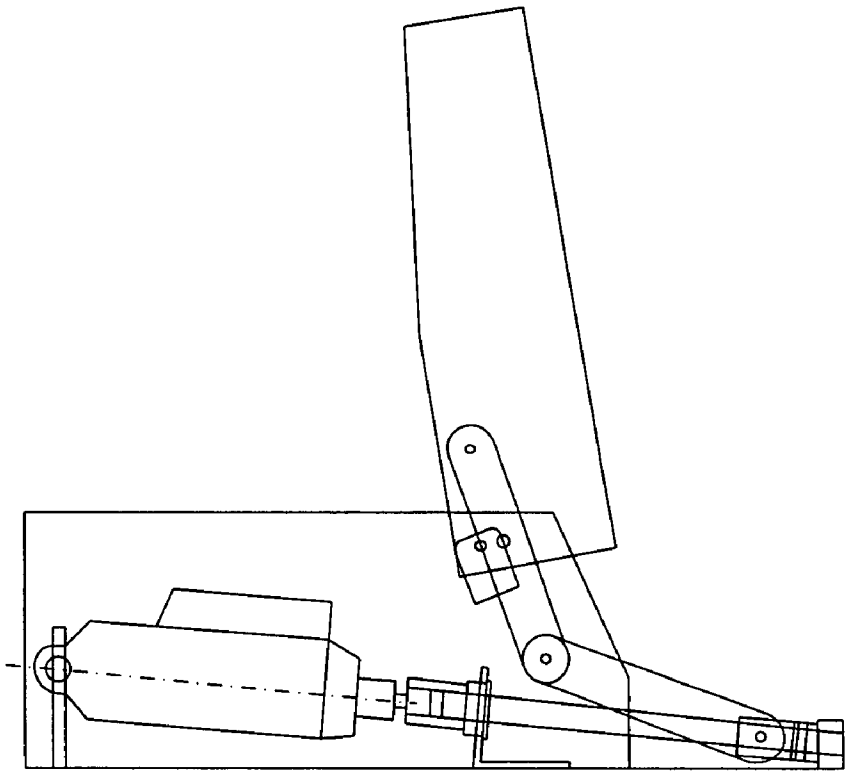
FIG. 11. shows an alternative embodiment in which the base is angled.
Figure 11A:
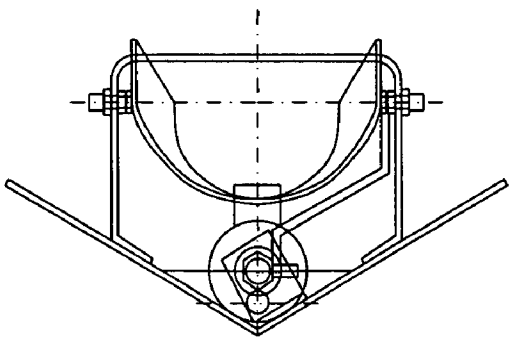

In a preferred embodiment, as shown in FIG. 1, an elbow flexion device as embodied in the present invention is comprised of a base 100, preferably made of wood or some other sturdy material. The base may be fitted with an extended angular support 110 underneath one side, as shown in FIG. 3, to tilt the base at an angle of approximately 25 degrees or such other angle as will bring the lifted arm toward the user's face. These angular supports may be reversible to accommodate either arm. Alternatively, the base may angled to tilt the device without such angular supports, as in FIG. 11. A support (the "pivot support") 200 is fastened to the base. The pivot support is comprised of at least one bracket 210 with a transverse hole 215. The transverse hole 215 serves as the rotational axis (the "pivot point") for the arm cradle 300.

Figure 2:
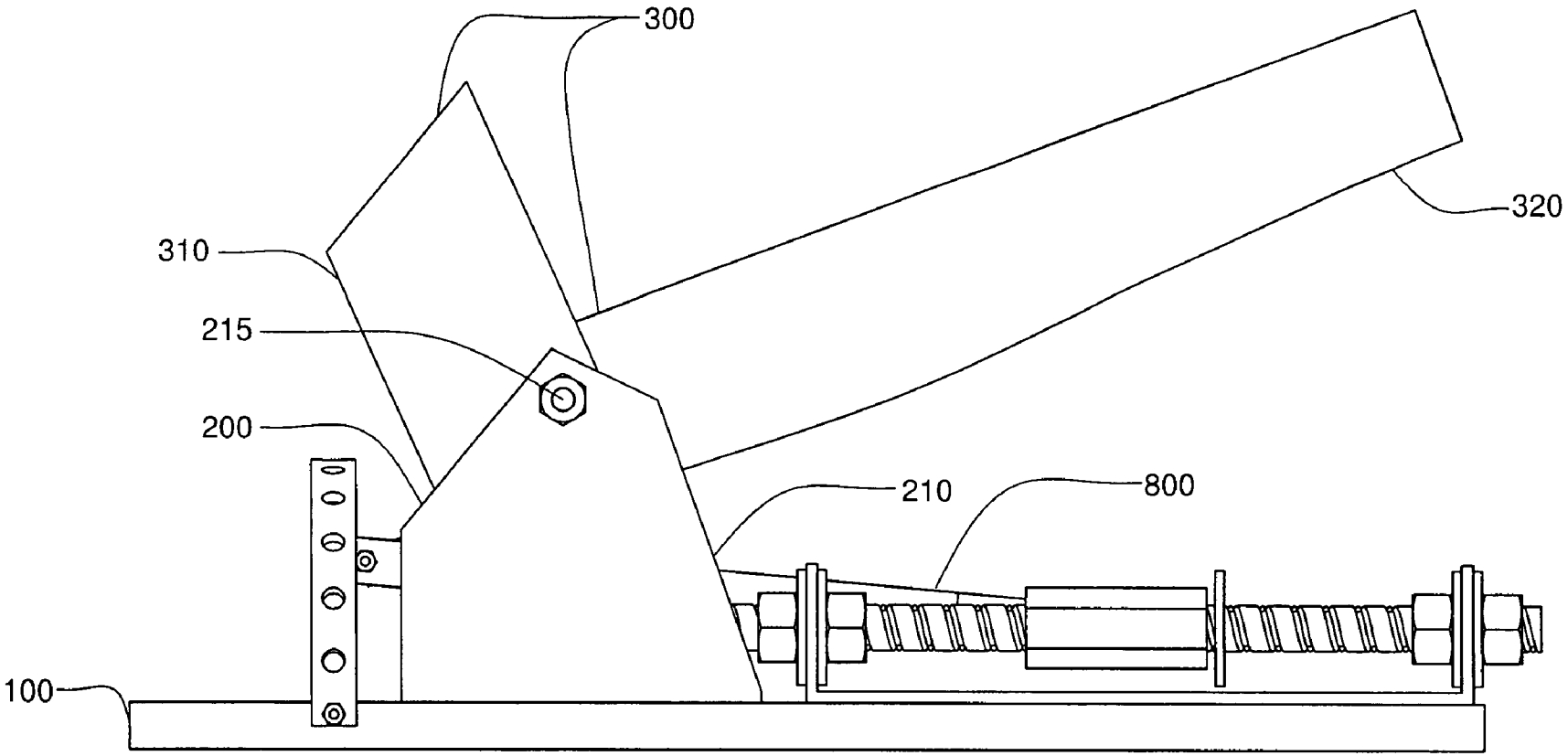
FIG. 2. shows a side view of the arm support and pivot support.

As shown in FIG. 2, The arm cradle 300 is preferably comprised of two troughs, a short upper trough 310 and a lower trough 320 composed of a flexible material such as polypropylene in which the upper and lower portions of the arm rest. An elbow pad (not shown), similar to those used by skateboarders and roller skaters, may be attached in order to deflect pressure on the elbow. The lower trough 320 contains at least one hole 325 for rotatably connecting the arm support 300 to the pivot support 200. Alternatively, the lower trough may have matching holes on either side, so that it can be connected to the pivot support on both sides of the arm and thus provide a pivot point at the midpoint of the elbow.

Figure 4:
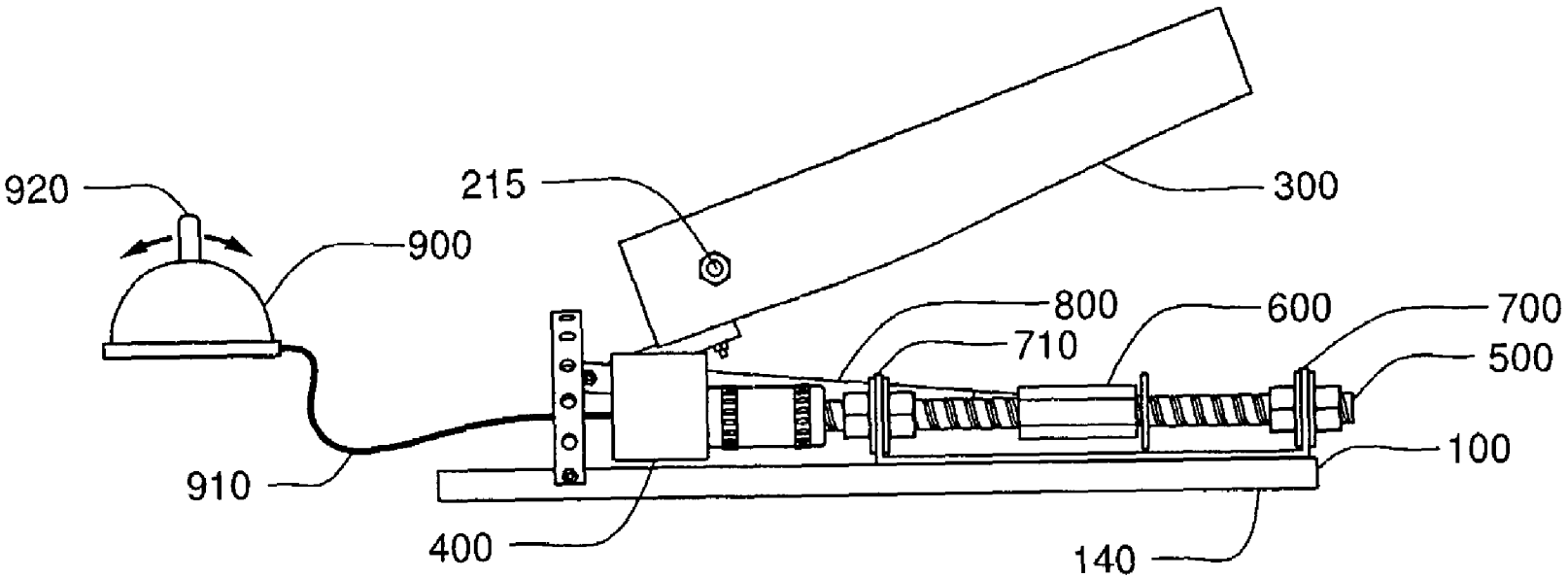
FIG. 4. shows a side view of the drive mechanism and control.

As shown in FIG. 4, a bi-directional motor 400 or another actuator system such as a cylinder (not shown) is mounted to the base 100 to provide the device with power. The motor may be battery powered, may operate from a standard 120 Volt outlet, or may connect directly to the power supply of the user's wheelchair if the wheelchair is motorized. The motor 400 is coupled to a lead screw 500, approximately 8 inches in length, which extends away from motor toward the opposing end 140 of the device. A nut 600 is mounted on the lead screw, which lead screw is then held in place by a bracket 700 mounted to the base 100 at the end of the base opposite the motor 400. In an alternative embodiment, the lead screw is held in place by two brackets 700 and 710 mounted to the base and disposed at either end of the lead screw. This embodiment has the advantage of preventing too much "travel" by the nut 600 in either direction along the lead screw 500. The nut 600 may be rotatably connected by a rigid link strap 800 to lower edge of the arm support 300, which prevents the nut from rotating with the screw. The rigid link strap can be attached via a screw, pin, or other means of connection that allows rotation; the arm support may have one hole for such connections, or a plurality of holes (not shown) to allow for adjustments for the measurements and comfort of the user.

Thus, when the motor 400 is activated, the lead screw 500 rotates, moving the nut 600 backward or forward laterally along the lead screw. The lateral motion of the nut 600, in turn, moves the link strap 700, causing the arm support to rotate on the pivot point 215, which in turn raises or lowers the user's arm.

The motor 400 is controlled by a control unit 900 actuated by the free hand. It may be connected either by wires 910 or by a wireless signal/receiver set (not shown) such as those commonly found in remote-controlled model cars. The control unit preferably has a double throw, momentary contact switch 920 that is sensitive to small movements and pressures and thus can be operated by users with weakened muscles and/or a limited range of motion. The double throw momentary contact switch has two momentary "on" positions; thus, the motor can be actuated to rotate the lead screw both clockwise and counterclockwise, to move the nut backward or forward as the user desires. If the motor is powered by batteries, the batteries may be contained in the control unit. Alternatively, if the control unit actuates the motor through a wireless signal/receiver set, the motor would have either a 120 Volt plug (not shown) or a battery adjacent to or within the motor housing, and the control unit would have its own battery. Control of the motor is obtained through small movements of the double throw momentary contact switch, such as a rocker switch or a joy stick, by the user's other (non-supported) hand. When actuated, the motor rotates the drive screw as described above. When the switch is released, the switch returns to an upright position and the motor ceases rotation of the drive screw.

The user of the elbow flexion device places one arm into the arm support 300, which rests on a base (not shown), generally a table or the tray of a wheelchair in which the user sits. The control unit 900 is placed near the hand of the other arm. Using small motions of his hand and fingers, the user actuates the device by pushing the double throw momentary contact switch 920 in one of two directions, to raise and lower the supported arm and hand.

Figure 5A:
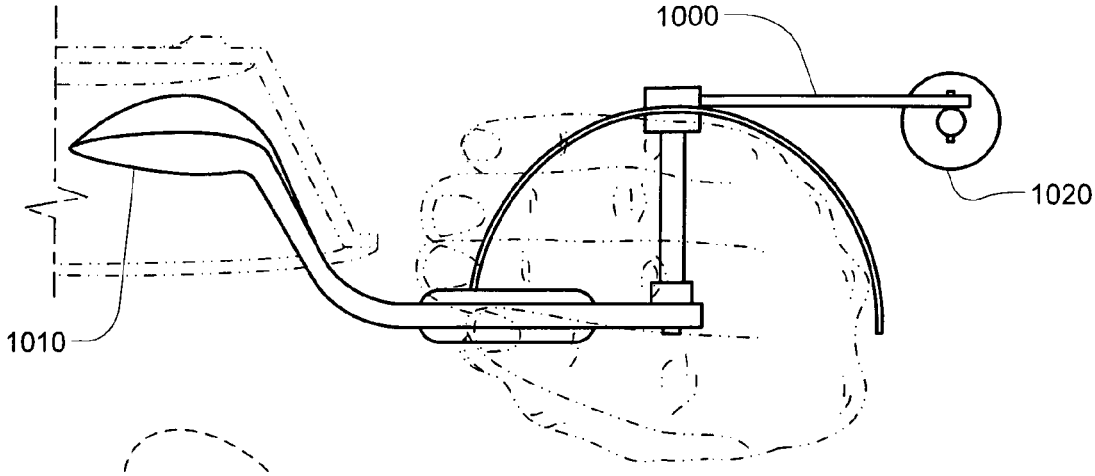
FIG. 5. shows a pivot attachment for assisting the user in controlling a utensil.
Figure 5B:
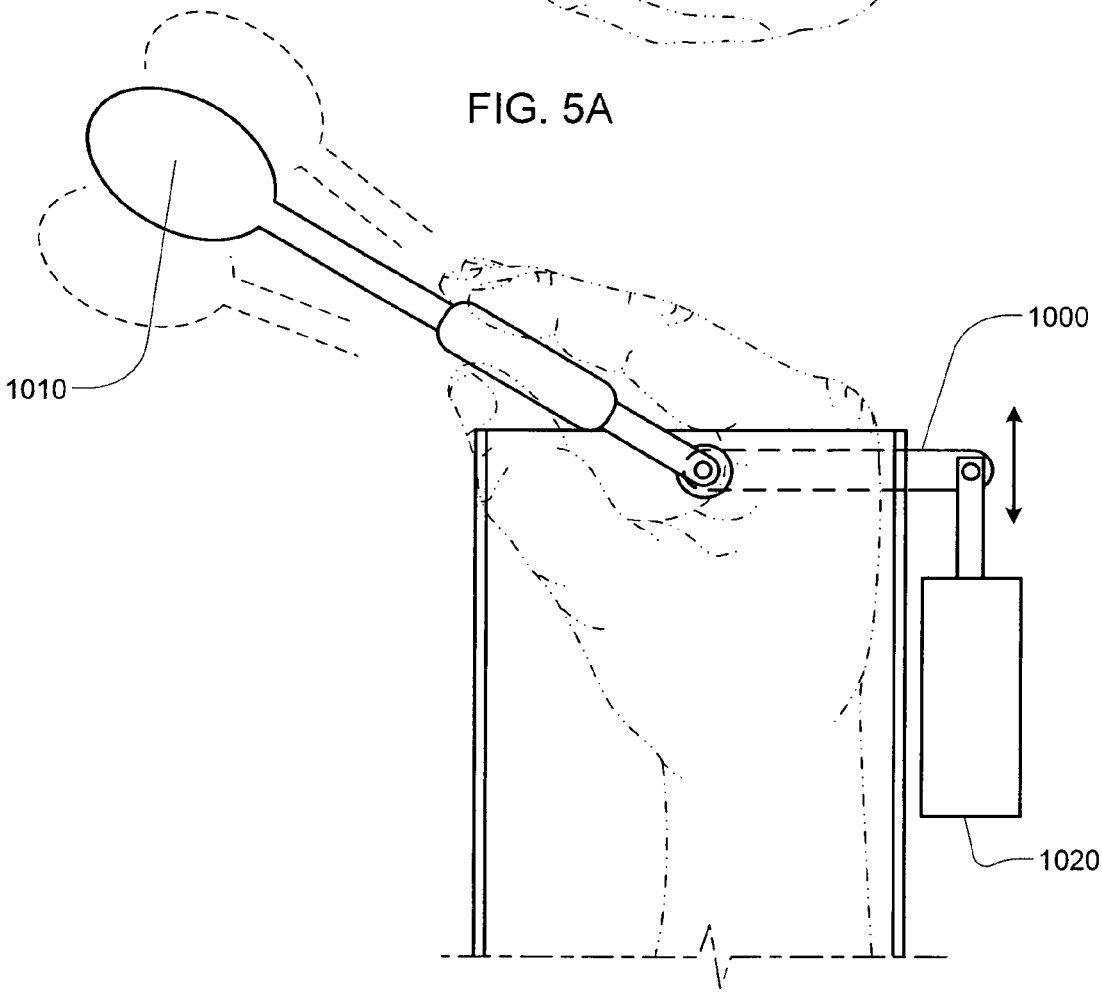
Figure 6:
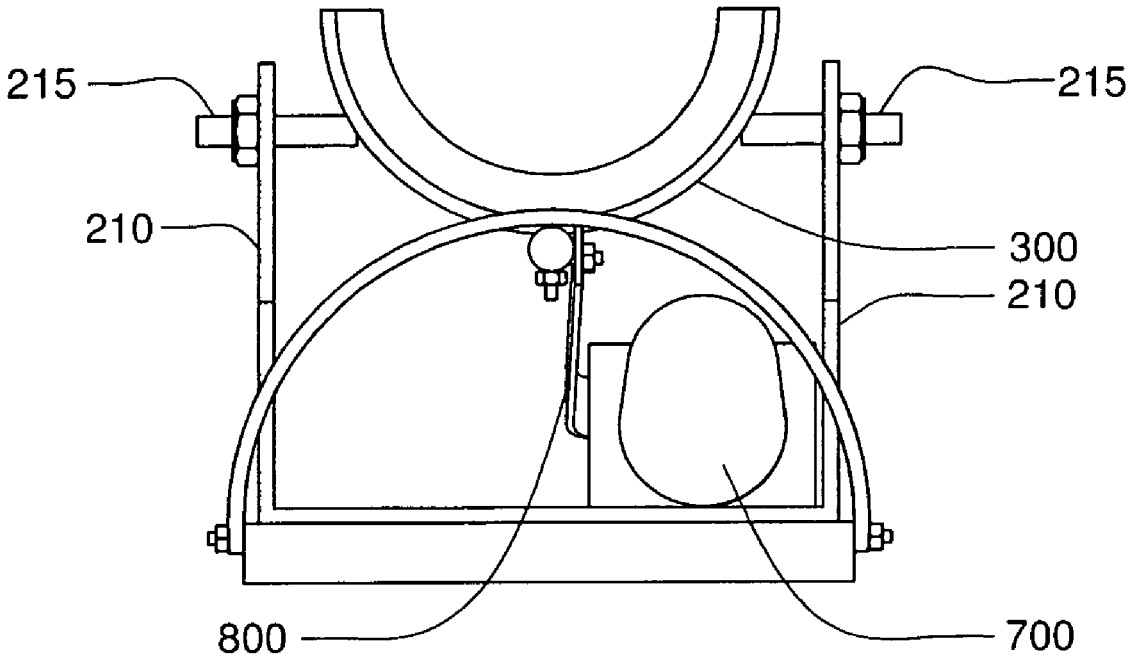
FIG. 6. shows an end view of the Arm Lift Flexion Device.
Figure 7:
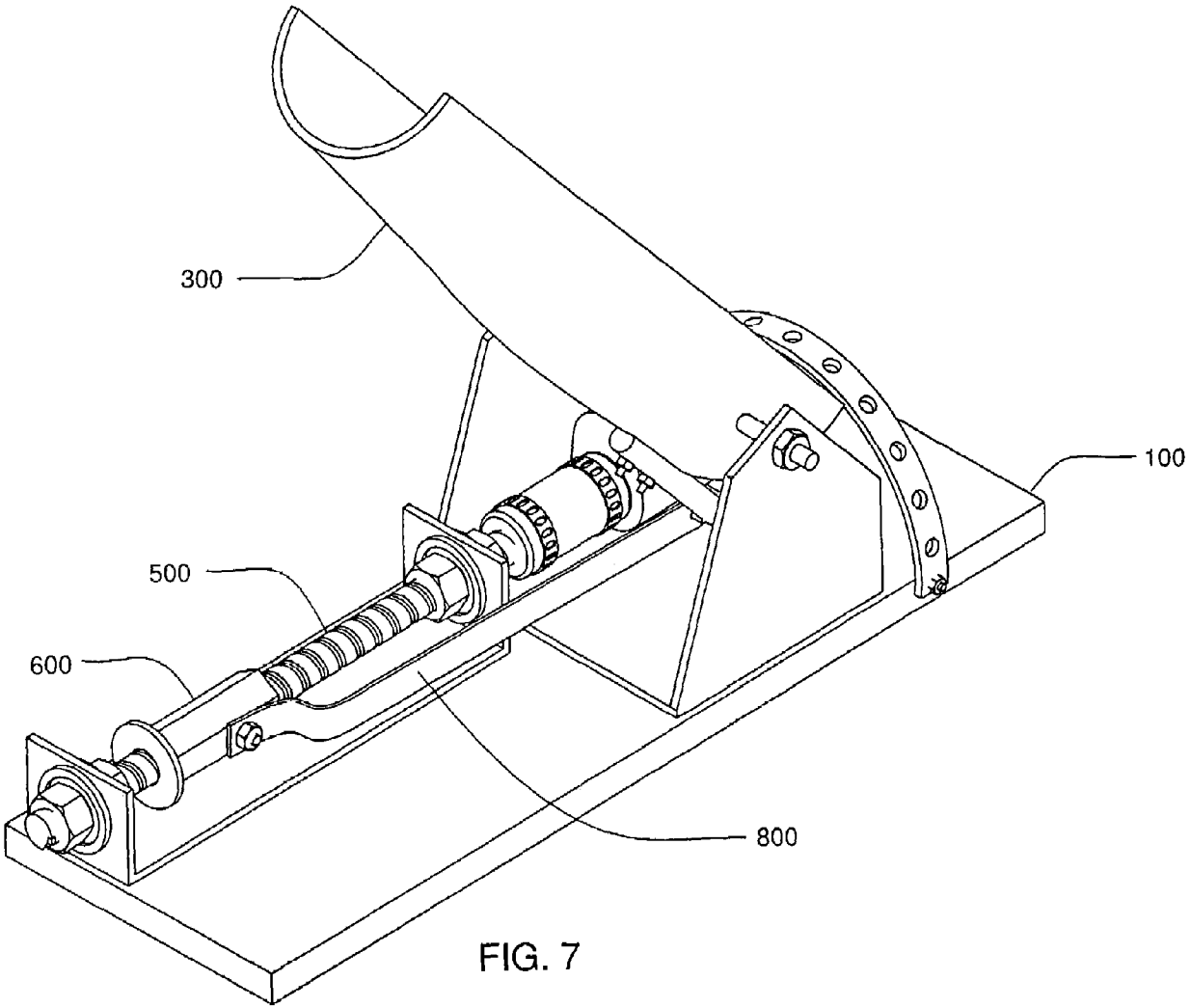
FIG. 7. shows a perspective view of the Arm Lift Flexion Device in the raised position showing the rigid strap assembly and its connection to the arm support.
Figure 8:
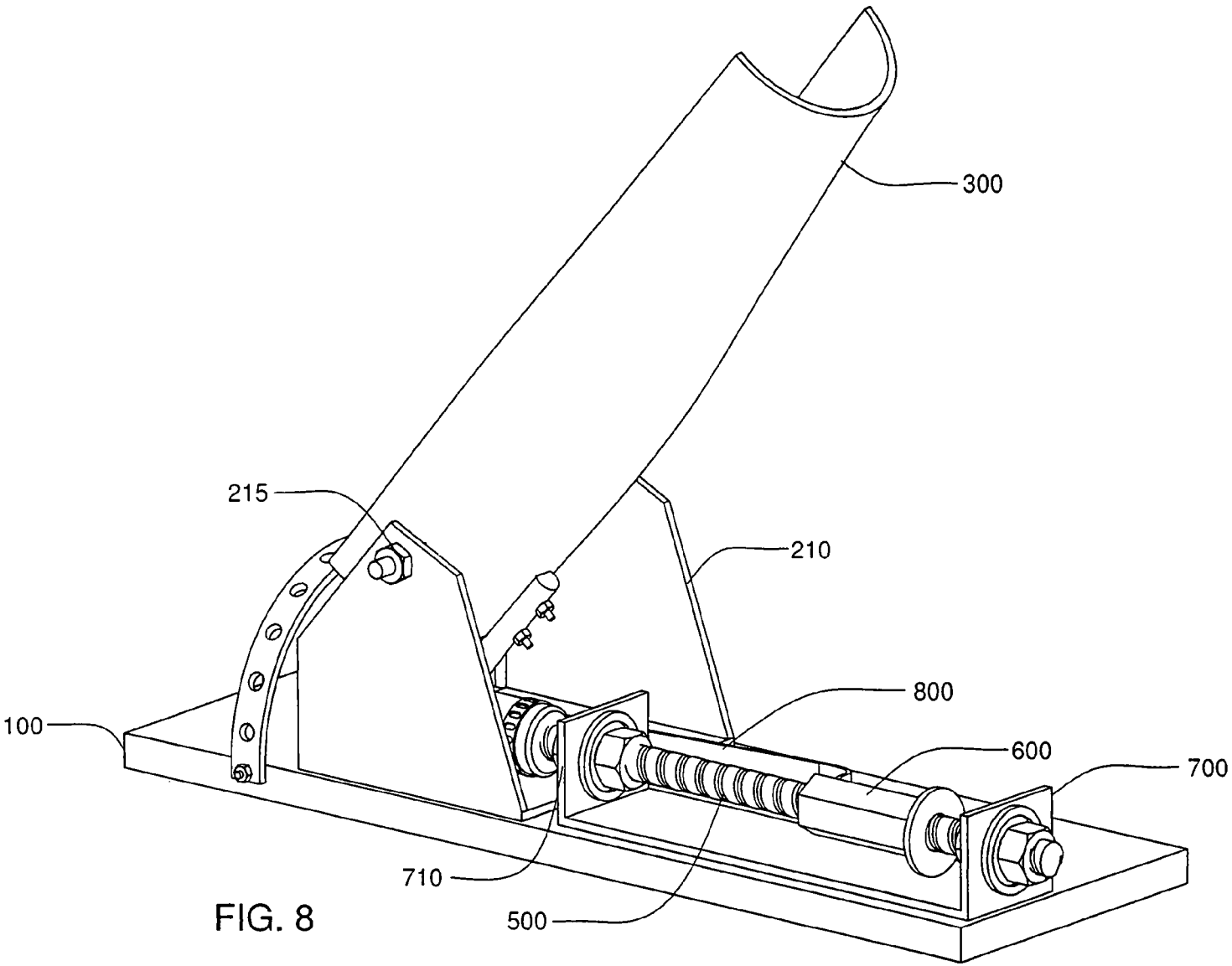
FIG. 8. shows a perspective view rotated 90 degrees from FIG. 7.
Figure 9:
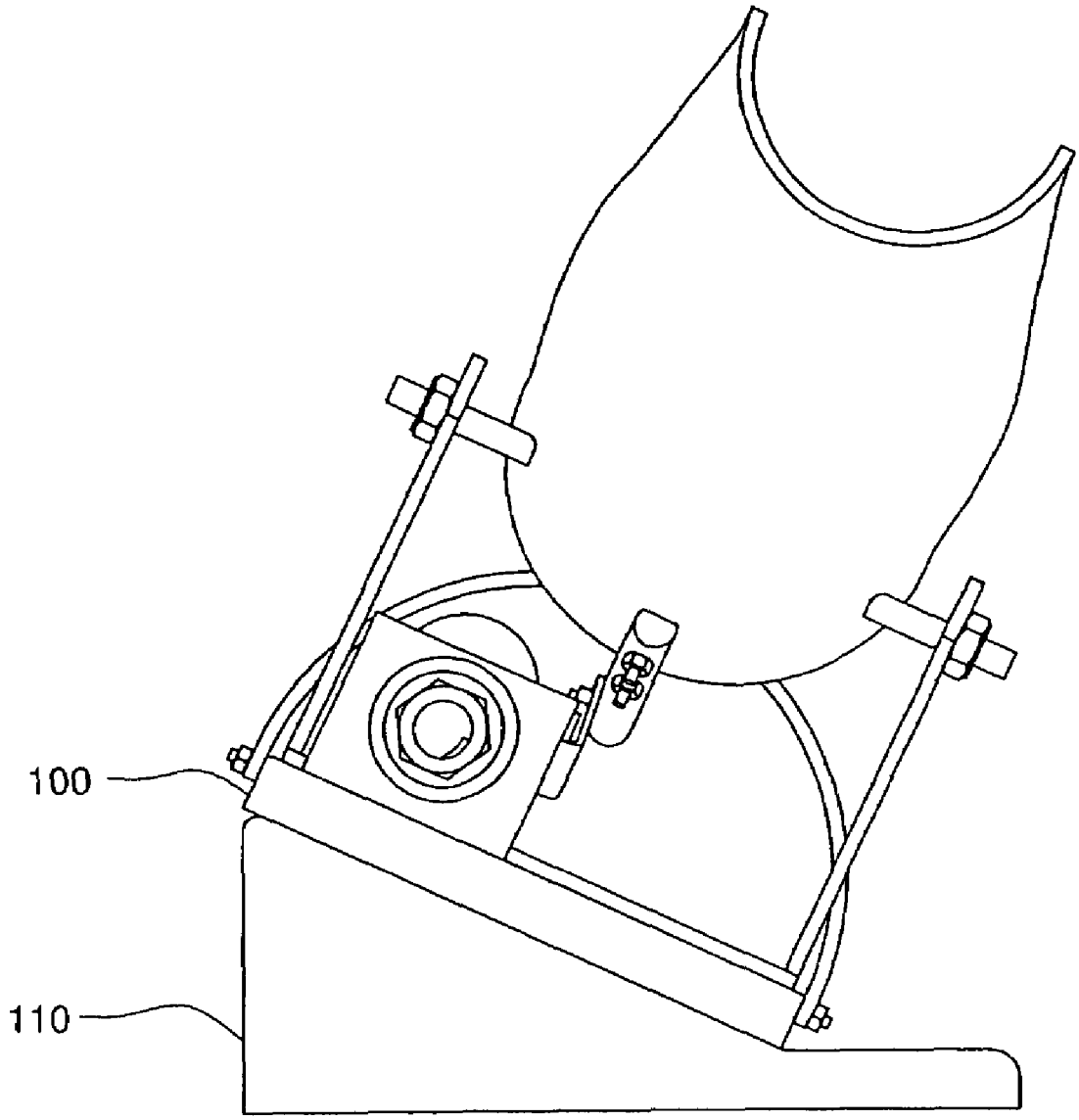
FIG. 9. shows an end view of the Arm Lift Flexion Device with extended angular support.
Figure 10:
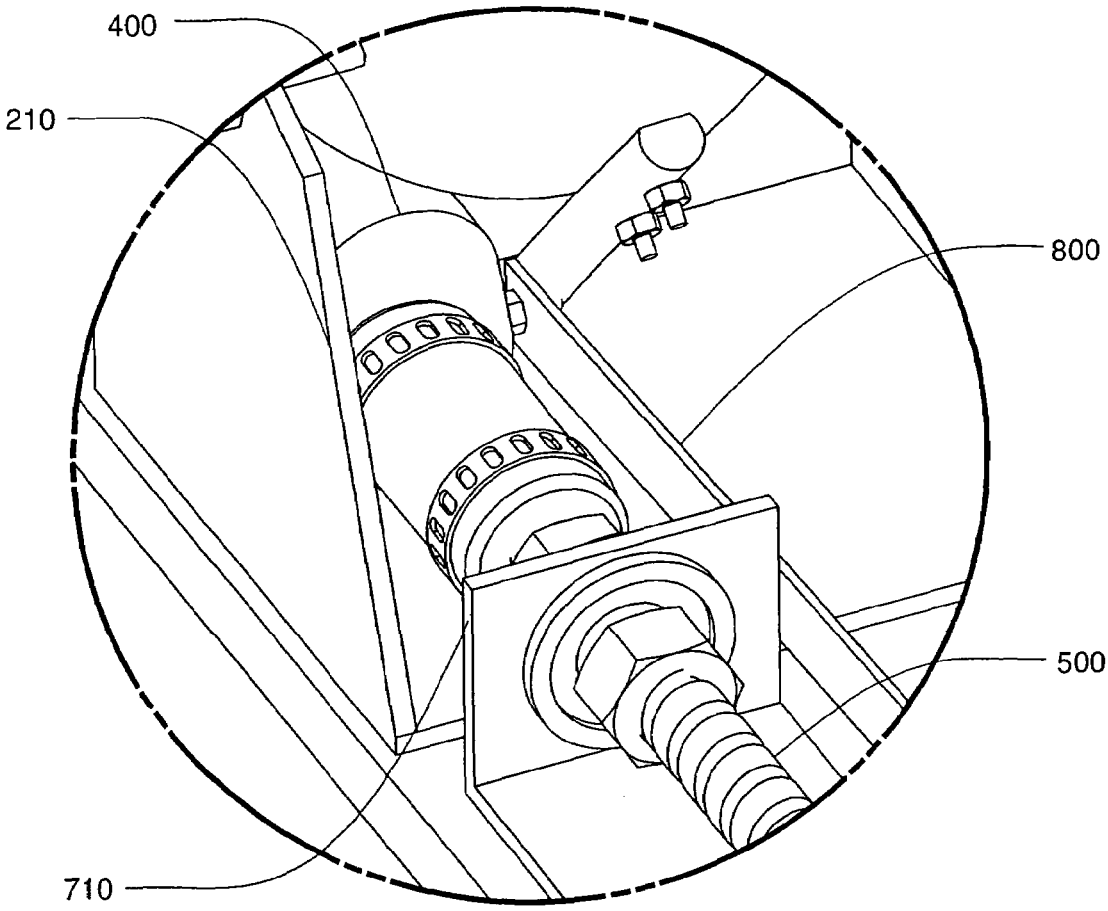
FIG. 10. shows a close-up of the connection between the rigid strap and the arm support.

As shown in FIG. 5, to further facilitate eating, a pivot attachment 1000 may be provided to guide a utensil 1010 (such as a spoon or a fork). A scoop plate (not shown) may also be provided in which food collects at the bottom to facilitate collection with the use of the utensil. An actuator (1020) such as a solenoid may be provided to move the lowered spoon into the collected food with switches for automatic operation, actuated by the position (i.e. either raised or lowered) of the elbow flexion device.

The above description and drawings are only illustrative of preferred embodiments that achieve the objects, features and advantages of the present invention, and it is not intended that the present invention be limited thereto. Any modification of the present invention that comes within the spirit and scope of the following claims is considered part of the invention.

ANNEX 1

Glossary of Terms

Unless otherwise required by the context of their use, the following terms are defined and shall be construed as follows:

"Bracket" means a projecting element or hardware attached to the surface of a member to support other members.

"Contracture" means a permanent muscle shortening.

"DMD" means Duchenne Muscular Dystrophy.

"Flexion" means movement about a joint in which the bones on either side of the joint are brought closer together, decreasing the angle of the bones forming a joint. Flexion is the opposite of extension.

"Including" means "including without limitation."

"Or" means inclusive or. Thus, "A or B" is true if either or both A and B are true.

What is claimed is:

1. An elbow flexion device comprising
   - A base, comprised of a top surface and a bottom surface, in which said top and bottom surfaces are not parallel, creating an angle on the top surface of the base so that the flexion device is inclined from a horizontal plane,
   - A bi-directional actuator mounted to said base,
   - A control unit for actuating said bi-directional actuator,
   - A drive screw attached to such actuator such that activation of the actuator rotates the drive screw,
   - A nut threaded to said drive screw,
   - A rigid strap rotatably connecting said nut to an arm cradle,
   - Said arm cradle for holding users arm, and
   - A pivot support attached to said base for providing a pivoting support for said arm cradle.

2. The device of claim 1, in which the base comprises two bottom surfaces fixedly joined at an angle, so that the flexion device is inclined from a horizontal plane either to the user's left or right.

3. The device of claim 2, in which the bottom surfaces of the base are disposed at equal angles to the flexion device, permitting the device to be used by either arm of the user.

4. The device of claim 1, in which the control unit actuates the actuator through wireless means.

5. The device of claim 1, in which the control unit contains a double throw, momentary contact switch.

6. The device of claim 5, in which the double throw, momentary contact switch is a rocker switch.

7. The device of claim 5, in which the double throw, momentary contact switch is a joystick.

8. The device of claim 1, further comprising a utensil holder attachment equipped with an actuator to provide powered angular movement and controls enabling automatic operation.

9. The device of claim 8, in which the utensil hold attachment is actuated by a solenoid.

10. The device of claim 8, further comprising a utensil.

11. The device of claim 10, in which the utensil is a fork.

12. The device of claim 10, in which the utensil is a spoon.

13. The device of claim 1, further comprising a scoop plate.

* * * * *